US005562019A

United States Patent [19]

Kropp

[11] Patent Number: 5,562,019

[45] **Date of Patent: * Oct. 8, 1996**

[54] HYDROSTATIC DRIVE SYSTEM

[75] Inventor: Walter Kropp, Sulzbach am Main, Germany

[73] Assignee: Linde Aktiengesellschaft, Germany

[ * ] Notice: The portion of the term of this patent subsequent to Oct. 24, 2012, has been disclaimed.

[21] Appl. No.: 450,354

[22] Filed: May 25, 1995

Related U.S. Application Data

[63] Continuation of Ser. No. 142,193, Oct. 22, 1993.

[30] Foreign Application Priority Data

Oct. 22, 1992 [DE] Germany ..... 42 35 709.8

[51] Int. Cl.[6] ..... F15B 11/042

[52] U.S. Cl. ..... 91/516; 91/526; 91/531; 91/446; 60/422

[58] Field of Search ..... 91/446, 451, 512, 91/516, 517, 518, 526, 528, 529, 530, 531; 60/422, 445, 452, 468

[56] References Cited

U.S. PATENT DOCUMENTS 4,665,699 5/1987 Krusche .
4,938,023 7/1990 Yoshino ..... 91/518
5,063,742 11/1991 Yoshimatsu ..... 60/468
5,134,853 8/1992 Hirata et al. ..... 91/518
5,209,063 5/1993 Shirai et al. ..... 60/422

FOREIGN PATENT DOCUMENTS 180804 10/1983 Japan ..... 91/451

*Primary Examiner*—F. Daniel Lopez
*Attorney, Agent, or Firm*—Thomas R. Shaffer, Esq.

[57] ABSTRACT

A hydrostatic drive system including a pump (1) and consumers (6, 8) which can each be actuated by a directional control valve (5,7) is disclosed. Each directional control valve (5, 7) is assigned a pressure compensator (9, 10) which can be controlled by a signal difference formed from a load pressure signal and a delivered pressure signal. The load pressure signal is derived from the highest of the load pressures occurring downstream of the directional control valves (5, 7), and the delivered pressure signal is derived from the pressure upstream of the directional control valves (5, 7). To limit the driving force and driving moment of at least one of the consumers, the signal difference across the pressure compensator (9) of at least one consumer (6) can be influenced by a controllable pressure output signal of an infinitely variable pressure control valve in such a way as to adjustably limit through-flow across the pressure compensator.

7 Claims, 1 Drawing Sheet

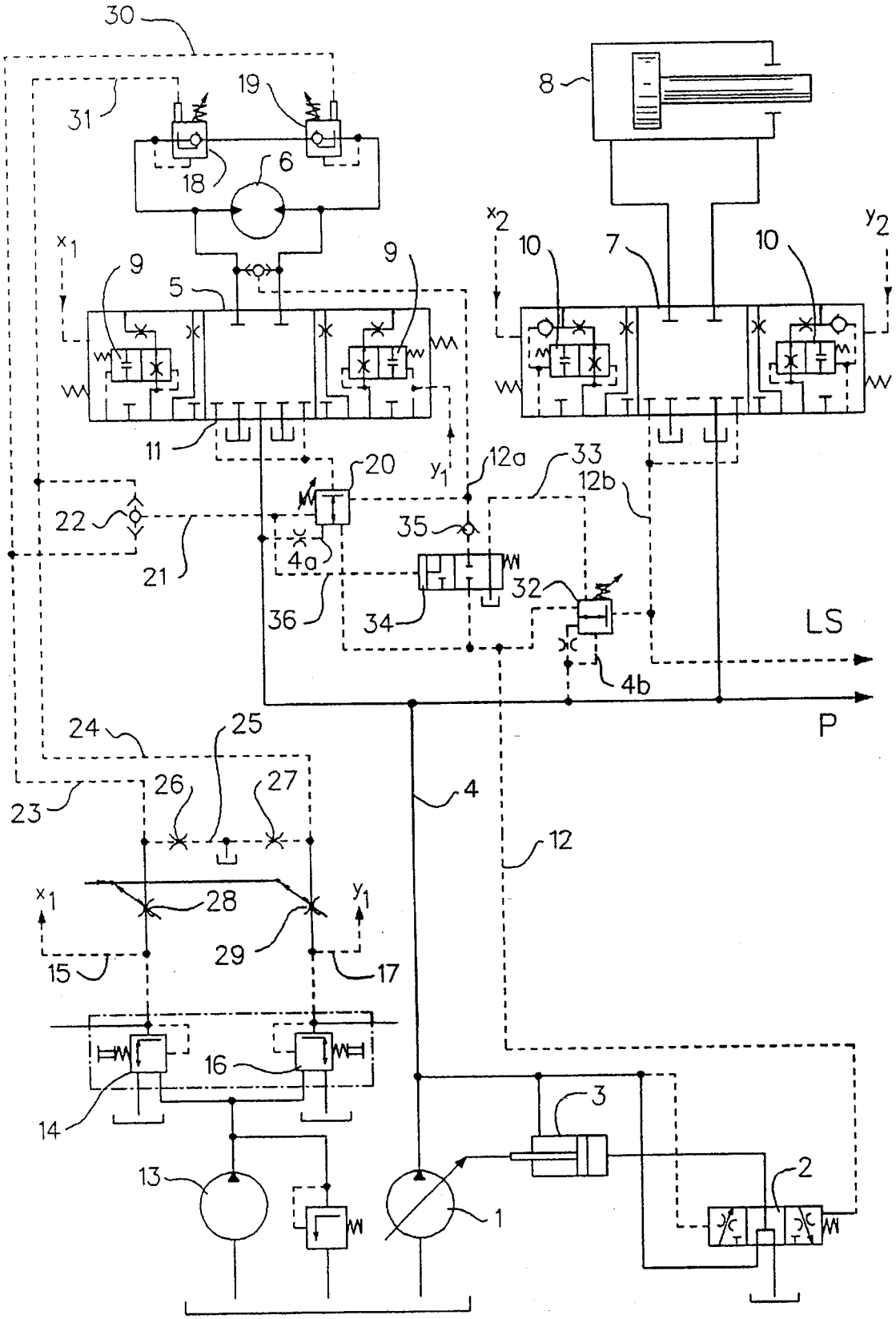
30
31
19
18
6
8
x1
9
5
9
x2
10
7
10
y2
11
20
y1
12a
33
12b
22
35
4a
21
36
34
32
LS
4b
P
24
25
23
26
27
4
12
x1
28
y1
29
15
17
16
14
3
13
2
1

HYDROSTATIC DRIVE SYSTEM

This application is a continuation of application Ser. No. 08/142,193, filed Oct. 22, 1993.

BACKGROUND OF THE INVENTION

1. Field of the Invention

The invention relates to a hydrostatic drive system comprising a demand-regulated pump and a plurality of consumers which are connected thereto and which can each be actuated by means of a directional control valve which performs a throttling function in intermediate positions. For load-independent allocation of the delivered flow in the case of simultaneously actuated consumers, each directional control valve is assigned a pressure compensator which can be controlled directly or indirectly by a signal difference formed from a load pressure signal and a delivered pressure signal, where the load pressure signal is derived from the highest of the load pressures occurring downstream of the directional control valves and the delivered pressure signal is derived from the pressure upstream of the directional control valves.

2. Description of the Prior Art in such drive systems, the degree of opening of the directional control valves, independently of the load pressure of the consumers, determines the volume flow of pressure medium which is supplied to the consumers, and thus the speed of movement of the consumers. The load-dependent delivered flow allocation is effected here by pressure compensators, which are also known as load compensators and which can be arranged upstream or downstream of the directional control valves. It is also possible to integrate the pressure compensators into the directional control valves. However, control of the driving force and the driving moment of the consumers is not possible with such drive systems.

To ensure that the pressure medium is supplied to a consumer at a specified pressure, in DE-OS 31 46 561, which is not of the type defined in the introduction, it has been proposed that in the case of a specially designed directional control valve, which does not comprise an assigned pressure compensator for load-independent delivered flow distribution, the adjusting force which determines the degree of opening of the directional control valve be opposed by a force derived from the load pressure of the consumer.

In such a drive system, which can be used both for translational and for rotational consumers, the pressure medium is therefore supplied to the consumer at a specified pressure, so that the consumer is moved with a correspondingly predetermined force and a predetermined torque. The force (or torque) acting upon the consumer here is substantially continuously maintained constant; in the event of a reduction in the consumer load, and thus an initially falling load pressure, because of the uniform adjusting force across the directional control valve, its through-flow opening enlarges until, due to the now increased volume flow conveyed to the consumer, the load pressure returns to the original level and the force difference originally set is again attained across the directional control valve. In such a drive system, in addition to the aforementioned disadvantage of the specially designed directional control valve, load-independent actuation of the consumer, which is desirable under certain operating conditions, is also no longer possible.

Furthermore, the force and torque limitation is not adjustable to different values.

SUMMARY OF THE INVENTION

The aim of the present invention is to provide a hydrostatic drive system of the type referred to in the introduction which is economical to produce and which is improved upon in respect of force and torque limitation at the consumer end.

This aim is fulfilled, in accordance with the invention, in that the signal difference across the pressure compensator of at least one consumer can be influenced by the controllable pressure output signal of an infinitely variable pressure control valve so as to adjustably limit the through-flow across the pressure compensator. The essential principle of the invention thus consists in that the pressure compensator for load-independent delivered flow allocation is also used to regulate the driving force and driving moment of the consumer. No specially designed directional control valve is required for this purpose. Furthermore, it also possible to drive the consumer in the usual manner, namely by presetting a theoretical value for the movement speed. If, on the other hand, the driving force and driving moment are to be limited, the pressure compensator is influenced in dependence upon a theoretical value which is to be preset and which determines the controllable pressure output signal of the adjustable pressure control valve. The force and moment regulation are thus controllable. The pressure compensator is influenced by changing the signal difference formed in most cases directly across the pressure compensator. For this purpose, preferably the signal operating in the closing direction is increased so that the pressure compensator moves in the closing direction. This effect could also be achieved by reducing the signal operating in the opening direction.

An advantageous embodiment of the invention provides that the pressure compensator comprises a control surface which is operative in the closing direction and which can be acted upon by the output-end controllable pressure of the pressure control valve, which latter has two inputs, of which the first input is connected to a line which conveys the maximum load pressure of all the consumers, and the second input is connected to a line which conveys the delivered pressure of the pump, and where the pressure control valve can be acted upon in the direction of an operating position, connecting the first input to the output, by a preferably adjustable spring and by a variable control signal, and can be acted upon in the direction of an operating position, connecting the second input to the output, by a signal derived from the individual load pressure of the consumer. The variable control signal, which acts on the small, cheaply produced pressure control valve provided in accordance with the invention, represents the theoretical value by which the driving force and driving moment of the consumer, which are to be regulated, are defined.

The control signal can be produced in any desired manner, for example electrically. However, it is favorable for the directional pressure control valve, which performs a throttling function in intermediate positions, to be actuatable hydraulically by the pressure in a control pressure line, where the control pressure line is connected to a control pressure branch line which leads to a control surface of the pressure control valve which operates to urge the valve in the direction of the operating position connecting the first input to the output. In this way the driving force and driving moment are regulated in dependence upon the control pressure acting upon the directional control valve. In the case of the hydraulic operation of the directional control valve, the means required to generate a control signal are already available and therefore it is sufficient to establish a connection from the control pressure source to the pressure control valve, which is easily possible. The control pressure can optionally be modified in order to obtain a particularly suitable variable control signal.

For this purpose it proves advantageous to connect the control pressure branch line to an outlet line with a constant choke, and to precede the outlet line by an adjustable choke. By changing the throttling cross-section of the adjustable choke it is possible to adjust the curve of the driving force and driving moment, i.e. the curve of this value in dependence upon the variable control pressure.

In the case of a consumer which is actuatable in both directions, for example a hydraulic motor, in accordance with a further development of the invention each operating direction is assigned a respective pressure limiting valve which in the opening direction can be acted upon by the load pressure of the consumer and in the closing direction can be acted upon by an adjustable spring and a variable control signal. This has the advantage that the braking moment (in the case of a hydraulic motor) and the braking force of the consumer are also regulated in dependence upon a desired value to be preset.

The outlay required for this purpose is low if the pressure limiting valve, provided in any event for the protection of the consumer, is equipped with a control surface which operates in the closing direction and communicates with a line connected to the control pressure branch line. Both the driving and the braking moment are therefore adjusted by control pressure from the same control pressure source, namely the control pressure source provided for driving the directional control valve. The maximum and minimum protection pressure of the pressure limiting valves are adjustable separately from one another, the minimum protection pressure being dependent upon the setting of the spring, and the maximum protection pressure being dependent upon the sum of the spring force and the force generated by the control pressure.

It is expedient to use the invention in a drive system in which the consumer is a hydraulic motor, in particular a hydraulic motor for driving an excavator slewing gear, as instantaneous control of the superstructure drive mechanism is very often required in such cases.

In a hydrostatic drive system, in specific operating situations it is desirable to give priority to one of the consumers. Such an operating situation is that, for example, in which, addition to this consumer, further consumers are actuated and the pump capacity is exhausted. Therefore, in a further development of the invention, it is proposed that the consumers downstream of the directional control valves are connected to a LS (load-sensing) line which leads to a required-flow regulator actively connected to the pump, and a priority valve is connected into the LS-line in such manner that in a first operating position of the priority valve the line sections downstream of the undetermined consumers, whose driving force and driving moment cannot be predetermined, are connected to the LS-line, and in a second operating position they are connected to a line which conveys the delivered pressure of the pump, where in the direction of the first operating position the priority valve can be acted upon by the delivered pressure of the pump and in the direction of the second operating position it can be acted upon by an adjustable spring and, in the event of the actuation of the consumer whose driving force and driving moment can be predetermined, additionally by the load pressure of this consumer. The priority valve, as well as the already described pressure control valve for adjusting a specified driving force and a specified driving moment, has very small structural dimensions and can easily be incorporated into a drive system of the type defined in the introduction.

It is advantageous that the consumers be connected via non-return valves to the LS-line and that downstream of the non-return valve assigned to the predetermined consumers whose driving force and driving moment can be predetermined there is arranged a switching valve which possesses a first switching position, which is operative when the consumer is unactuated and wherein the connection to the LS-line is blocked and a line which terminates before the control surface of the priority valve operating in the direction of the second operating position is connected to an outlet line, and which possesses a second switching position which is operative when the consumer is actuated and wherein the LS-line is connected to the consumer and to the line leading to the control surface of the priority valve. The priority valve thus operates in dependence upon the actuation of the directional control valve assigned to the first consumer.

The actuation of the first consumer can easily be detected in that the switching valve can be switched by the control pressure which acts on the directional control valve of the first consumer.

BRIEF DESCRIPTION OF THE DRAWING

The invention will be explained in detail with reference to the exemplary embodiment schematically illustrated in the accompanying drawing which shows the switching plan of a hydrostatic drive system according to the invention.

DETAILED DESCRIPTION OF THE PREFERRED EMBODIMENT

Referring to the drawing, a pump 1, which is adjustable in respect of its delivered volume, comprises a required-flow regulator 2 which controls a cylinder-piston arrangement 3 for adjusting the delivered volume of the pump 1. The pump 1 is connected via a delivery line 4 to a directional control valve 5 which controls a first consumer 6, which in this exemplary embodiment is a hydraulic motor. The hydraulic motor 6 can be operated in both directions and is to be assigned to the slewing drive mechanism of an excavator. The delivery line 4 is additionally connected to a directional control valve 7 with which a second consumer 8, in the form of a hydraulic cylinder, can be actuated. Further, consumers can also be supplied by the pump 1 by connecting them to delivery line 4 at P.

For load-independent delivered flow allocation, each consumer 6 and 8 is assigned a respective pair of pressure compensators 9 and 10 which are integrated in the directional control valves 5 and 7 and which possess a closing position and an opening position. In the example, a respective pressure compensator is provided for both actuating directions of the consumers. It is also possible to provide only one pressure compensator for each directional control valve 5 and 7, which pressure compensator is connected in such manner that it is operative in each actuating direction.

To avoid unnecessary repetitions, in the following the function only of the left-hand pressure compensator 9 in the directional control valve 5, which can be controlled directly by a signal difference, will be described. Here "directly" is to be understood as a direct reproduction of the signal difference across the pressure compensator. Indirect control would be that in which the signal difference were formed at a different location and only the result were communicated to the pressure compensator. The signal difference is formed form a load pressure signal and a delivered pressure signal. Normally the load pressure signal is derived from the highest of the load pressures of all the actuated consumers. For the direct reproduction of the signal difference across the pressure compensator 9, the latter possesses a control surface which is operative in the opening direction and can be acted upon by the pressure upstream of the directionally control valve 5. In the closing direction, the pressure compensator can be acted upon by the pressure conveyed in a line 11. For the predetermination of the movement speed, this is one of the pressures downstream of the directional control valve 5 or 7, namely the highest of the load pressures of the consumers 6 or 8. In the closing direction the force of a spring is also always active. This spring force corresponds to the force of a spring acting on the required-flow regulator 2.

If neither of the consumers 6 and 8 is actuated because the directional control valves 5 and 7 are in the blocked state, the pump 1 delivers only leakage oil, and thus assumes a setting with a low delivered volume, where the delivered volume and the delivered pressure are determined by the spring of the required-flow regulator 2. An equilibrium of forces acting on a moving control member is obtained in the required-flow regulator 2. Here, the spring force counteracts a force which originates from the delivered pressure acting upon a control surface of the control member.

When consumer 6 is required to operate, the directional control valve 5 is actuated to provide a connection between the pump 1 and the consumer 6. The pressure which builds up downstream of the directional control valve 5 is communicated by a so-called LS-line 12 (load-sensing line) to the spring side of the required-flow regulator 2, with the result that the previously prevailing equilibrium is disturbed and the pump 1 is supplied with a signal to increase the delivered volume. Then the delivered volume of the pump 1 increases and consequently also the delivered pressure of the pump. Above a specified delivered pressure, the consumer 6 is set in motion. The opening which is released in the directional control valve 5 here acts as measurement choke across which a pressure drop delta p occurs. The delivered volume of the pump 1 is increased until a pressure drop delta p occurs across the measurement choke, which pressure drop corresponds to the spring bias of the required-flow regulator 2.

If the second consumer 8 is switched on and if a greater load pressure prevails therein than in the first consumer 6, the delivered volume of the pump 1 is adjusted in accordance with the requirement of the second consumer 8. To prevent any increase occurring now in the speed of movement of the first consumer 6, the pressure compensator 9 assigned to the directional control valve 5 throttles the in-flowing pressure medium until the pressure drop across the through-flow opening (measurement choke) of the directional control valve corresponds again to the given value. The speed of movement of the first consumer 6 is consequently not only independent of its own load pressure but also independent of the load pressure of the second consumer 8.

The directional control valves 5 and 7 shown in the FIGURE are driven hydraulically. The means required for this purpose are shown in the example of the driving of the directional control valve 5. A constant pump 13 acts upon a control pressure generator 14 which generates a control pressure $x_1$ which is conveyed in a control pressure line 15. By applying pressure $x_1$ to valve 5 the directional control valve 5 is moved to the right as seen in the FIGURE. Additionally, a control pressure generator 16 is acted upon by the constant pump 1 and generates a control pressure $y_1$ which, when applied to valve 5 via a control pressure line 17, moves the directional control valve 5 to the left as seen in the FIGURE.

For the protection of the hydraulic motor, a respective pressure limiting valve 18 and 19 is provided for each direction of actuation.

Hitherto, the hydrostatic drive system corresponds to the prior art.

The output of a pressure control valve 20 is connected to the line 11 which communicates with that control surface of the pressure compensator 9 which causes the closing of the pressure compensator. The pressure control valve 20 has two inputs, of which one input is connected to the LS-line 12 and the other input is connected to a line **4*a* which branches off from the delivery line 4 of the pump 1. The pressure control valve possesses two switching positions, namely a first switching position in which the LS-line 12 is connected to the line 11, and a second switching position in which the line 4*a* conveying the delivered pressure is connected to the line 11. Between the two switching positions, intermediate positions can be provided. The pressure control valve 20 is biased towards the first switching position, preferably by resilient means wherein the spring force is adjustable. Additionally, a control surface which operates in the direction of the first switching position is provided on the pressure control valve 20. This control surface can be acted upon by the pressure in a line 21 which is connected via a changeover valve 22 to respective control pressure branch lines 23 and 24 connected to the control pressure line 15 and 16. A control surface of pressure control valve 20 which is operative to move valve 20 in the direction of the second switching position can be acted upon by the pressure in a section 12*a* of the LS-line 12 upstream of a non-return valve 25 which opens in the direction of the required-flow regulator. This pressure is the load pressure of the consumer 6**.

When the consumer 6 is actuated, control pressure $x_1$ or $y_1$ acts both upon the directional control valve 5 and upon the pressure control valve 20 in the direction of its first switching position. The control surface of the pressure compensator 9 which operates in the direction of the closing position is therefore connected via the line 11 to the LS-line 12 so that here the highest of all the load pressures come to bear.

As soon as the force which arises from the load pressure of the consumer 6 (hydraulic motor) proportional to the driving moment and which acts upon the pressure control valve 20 exceeds the opposing sum of the spring force and the control pressure force, the pressure control valve 20 connects the output-end line 11 to the line **4*a* which conveys the delivered pressure, so that the pressure compensator 9 is moved in the closing direction, whereby no further increase occurs in the load pressure of the consumer 6**, and consequently its driving moment is limited.

Here the equilibrium across the pressure control valve 20 is determined by the level of the variable control pressure which acts on the control surface which is operative to move valve 20 towards the first switching position. As a result, any desired limit value can be selected for the driving moment. Until the attainment of this predetermined limit value of the driving moment, the delivered flow allocation is load-independent, the speed of movement of the consumer 6 being predetermined by the directional control valve.

To facilitate the adjustment of the curve of the driving moment, the control pressure branch lines 23 and 24 are each connected to an outlet line 25 via a respective constant choke 26 and 27, and adjustable chokes 28 and 29 respectively are connected upstream of the outlet line 25 in the direction of each control pressure branch line 23 and 24. By changing throttling cross-section of the adjustable chokes 28 and/or 29, it is possible to select the curve of the driving moment in dependence upon the variable control pressure.

The pressure-limiting valves 18 and 19, which serve to protect the consumer 6, can be acted upon in the opening direction by the load pressure of the consumer 6 and in the closing direction by an adjustable spring and a variable control signal. For this purpose, each pressure limiting valve 18 and 19 is provided with a respective control surface which is operative in the closing direction and with which a respective line 30 and 31 connected to the control pressure branch line 23 and 24 communicates. The maximum and minimum protection pressures of the pressure limiting valves 18 and 19 are therefore adjustable separately from one another, where the minimum protection pressure is dependent upon the setting of the spring, and the maximum protection pressure is dependent upon the sum of the spring force and the force generated by the control pressure.

This has the advantage that the braking moment of the consumer 6 can also be regulated in dependence upon a theoretical value to be predetermined; the outlay required for this purpose is low as the pressure limiting valve 18 and 19, provided in any event for the protection of the consumer 6, additionally assumes this function. Thus, both the driving and the braking moment are set by control pressure from the same control pressure source, namely the control pressure source provided for the driving of the directional control valve.

Connected into the LS-line 12 is a priority valve 32 which, in a first operating position, connects a line section **12*b* which branches off from the consumer 8 downstream of the directional control valve 7, via a non-return valve, to the required-flow regulator 2 and in a second operating position connects this line section to a line 4*b* which branches off from the delivered pressure line 4. The priority valve 32 can be acted upon in the direction of the first operating position by the delivered pressure of the pump which acts on a correspondingly arranged control surface, and can be acted upon in the direction of the second operating position by an adjustable spring and by the pressure in a line 33** which communicates with a correspondingly arranged control surface.

Downstream of the non-return valve 35 assigned to the consumer 6 is a switching valve 34 which can occupy a first and a second switching position. In the first switching position, the connection from the line section **12*a* to the LS-line 12 is blocked and the line 33 which communicates with that control surface of the priority valve 32 operative to urge the valve 32 toward the second operating position, is connected to an outlet line. In the second switching position, the LS-line 12 is connected both to the line section 12*a* and to the line 33 which leads to the control surface of the priority valve 32**.

The priority valve 32 is initially maintained in the first switching position by the (small) force of a spring. The switch-over into the second switching position is effected by control pressure which is conveyed in the line 36 which branches off from the line 21. When the consumer 6 is unactuated, the switching valve 34 remains in the first switching position. The second switching position comes into operation as soon as the consumer 6 is actuated as a result of the conveyance of control pressure to its directional control valve 5. In this case, that control surface of the switching valve 34 which is operative in the direction of the second operating position is acted upon by the pressure in the LS-line 12. The priority valve 32 thus operates in dependence upon the driving of the directional control valve 5 assigned to the first consumer 6 and ensures that the pressure compensator 10 of the consumer 8 (and optionally the pressure compensators of further consumers) is moved in the closing position so that the consumer 6 is supplied with priority with pressure medium.

The degree of priority given to the consumer 6 is adjustable in the present case by virtue of the level of the control pressure which determines the level of the load pressure of the consumer 6, where this load pressure is conveyed in turn by the switching valve 34 to the control surface of the priority valve 32.

It is thus possible to give priority to the consumer 6 in specific operating situations. Such an operating situation is, for example, that in which, in addition to the consumer 6, further consumers are actuated and the delivery capacity of the pump 1 has already been fully taken up.

While certain presently preferred embodiments of the present invention have been described and illustrated, it is to be distinctly understood that the invention is not limited thereto but may be otherwise embodied and practiced within the scope of the following claims.

I claim:

1. A hydrostatic drive system with a required-flow regulated pump providing a delivered pressure and a plurality of consumers connected to said pump, said consumers capable of being actuated by means of directional control valves, said directional control valves having an inlet side and an output, said output providing a flow output signal, said directional control valves adapted for movement in an least one of an opening direction and a closing direction and performing a throttling function in intermediate positions, wherein, for load-independent allocation of a delivered flow, in the case of simultaneously actuated consumers each directional control valve is assigned a pressure compensator having an opening and a closing position and performing a throttling function in intermediate positions which can be controlled directly or indirectly by a signal difference formed from a load pressure signal and delivered pressure signal, where the load pressure signal is derived from the highest of the load pressures occurring downstream of the directional control valves, and the delivered pressure signal is derived from the pressure upstream of the directional control valves, and wherein the signal difference across the pressure compensator of at least one consumer is adapted to be influenced by a controllable pressure output signal of an infinitely variable pressure control valve in such a way as to adjustably limit through-flow across the pressure compensator.

2. A hydrostatic drive system according to claim 1, wherein the at least one consumer is adapted to be actuated in both said opening direction and in said closing direction, and wherein each operating direction is assigned a respective pressure limiting valve having an opening direction and a closing direction and which, in the opening direction, is adapted to be acted upon by the load pressure of the consumer and, in the closing direction, is adapted to be acted upon by an adjustable spring and a variable control signal.

3. A hydrostatic drive system according to claim 1, wherein the at least one consumer is a hydraulic motor adapted for driving an excavator slewing gear.

4. A hydrostatic drive system with a required-flow regulated pump providing a delivered pressure and a plurality of consumers connected to said pump, said consumers capable of being actuated by means of directional control valves, said directional control valves having an inlet side and a flow output, said output providing a flow output signal, said directional control valves adapted for movement in at least one of an opening direction and a closing direction and performing a throttling function in intermediate positions, wherein, for load-independent allocation of a delivered flow, in the case of simultaneously actuated consumers each directional control valve is assigned a pressure compensator having an opening and a closing position and performing a throttling function in intermediate positions which can be controlled directly or indirectly by a signal difference formed from a load pressure signal and delivered pressure signal, where the load pressure signal is derived from the highest of the load pressures occurring downstream of the directional control valves, and the delivered pressure signal is derived from the pressure upstream of the directional control valves, and wherein the signal difference across the pressure compensator of at least one consumer is adapted to be influenced by a controllable pressure output signal of an infinitely variable pressure control valve in such a way as to adjustably limit through-flow across the pressure compensator, wherein the pressure compensator has a control surface which is operative in the direction of the closing position and which can be acted upon by the pressure output signal at an output of the pressure control valve, wherein the pressure control valve has first and second inputs, the first input is connected to a line which conveys the highest load pressure of all the consumers, and the second input is connected to a line which conveys pressure delivered by the pump, and wherein the pressure control valve is adapted to be acted upon by a resilient bias and by a variable control signal to urge it into a first operating position in which the first input is connected to the output, and is adapted to be acted upon by a signal derived from the individual load pressure of the at least one consumer to urge it into a second operating position in which the second input is connected to the output.

5. A hydrostatic drive system according to claim 4, wherein the directional control valve, which exerts a throttling function in intermediate positions, is adapted to be hydraulically operated by pressure in a control pressure line, the control pressure line being connected to a control pressure branch line which leads to a control surface of the pressure control valve which is operative to urge the pressure control valve in a direction of its first operating position.

6. A hydrostatic drive system according to claim 5, wherein said control pressure branch line is connected to an outlet line with a constant choke, and said outlet line is preceded by an adjustable choke.

7. A hydrostatic drive system with a required-flow regulated pump providing a delivered pressure and a plurality of consumers connected to said pump, said consumers capable of being actuated by means of directional control valves, said directional control valves having an inlet side and a flow output, said output providing a flow output signal, said directional control valves adapted for movement in at least one of an opening direction and a closing direction and performing a throttling function in intermediate positions, wherein, for load-independent allocation of a delivered flow, in the case of simultaneously actuated consumers each directional control valve is assigned a pressure compensator having an opening and a closing position and performing a throttling function in intermediate positions which can be controlled directly or indirectly by a signal difference formed from a load pressure signal and delivered pressure signal, where the load pressure signal is derived from the highest of the load pressures occurring downstream of the directional control valves, and the delivered pressure signal is derived from the pressure upstream of the directional control valves, and wherein the signal difference across the pressure compensator of at least one consumer is adapted to be influenced by a controllable pressure output signal of an infinitely variable pressure control valve in such a way as to adjustably limit through-flow across the pressure compensator, wherein the at least one consumer is adapted to be actuated in both said opening direction and in said closing direction, and wherein each operating direction is assigned a respective pressure limiting valve having an opening direction and a closing direction and which, in the opening direction, is adapted to be acted upon by the load pressure of the consumer and, in the closing direction, is adapted to be acted upon by an adjustable spring and a variable control signal, and, further comprising a control pressure branch line wherein at least one of said pressure limiting valves is provided with a control surface which is operative to urge the pressure limiting valve in its closing direction and which communicates with a line connected to the control pressure branch line, said control pressure branch line being connected to a control pressure line.

* * * * *

UNITED STATES PATENT AND TRADEMARK OFFICE

CERTIFICATE OF CORRECTION

PATENT NO. : 5,562,019

DATED : 10/8/96

INVENTOR(S) : Walter Kropp

It is certified that error appears in the above-identified patent and that said Letters Patent is hereby corrected as shown below:

Column 2, line 58, change "directional pressure control valve" to --directional control valve--

Signed and Sealed this

Ninth Day of December, 1997

*Attest:*

BRUCE LEHMAN

*Attesting Officer*

*Commissioner of Patents and Trademarks*